US006423965B1

(12) United States Patent
Hashimoto et al.

(10) Patent No.: US 6,423,965 B1
(45) Date of Patent: Jul. 23, 2002

(54) MASS SPECTROMETER

(75) Inventors: Yuichiro Hashimoto; Takayuki Nabeshima, both of Kokubunji; Yasuaki Takada, Kodaira; Minoru Sakairi, Tokorozawa; Masamichi Tsukada, Higashiibaraki-gun, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/378,767

(22) Filed: Aug. 23, 1999

(30) Foreign Application Priority Data

Aug. 24, 1998 (JP) ..... 10-237479

(51) Int. Cl.[7] ..... H01J 49/00; H01J 49/04

(52) U.S. Cl. ..... 250/288; 250/289; 250/281; 250/292; 250/396 R; 250/430; 250/423 R

(58) Field of Search ..... 250/288, 289, 250/281, 292, 430, 423 R, 396 R

(56) References Cited

U.S. PATENT DOCUMENTS

| | | | | |
|---|---|---|---|---|
| 4,578,589 A | * | 3/1986 | Aitken | 250/492.2 |
| 5,481,107 A | | 1/1996 | Takada et al. | 250/281 |
| 5,767,512 A | * | 6/1998 | Eiden et al. | 250/282 |
| 6,075,243 A | * | 6/2000 | Nabeshima et al. | 250/292 |
| 6,107,628 A | * | 8/2000 | Smith et al. | 250/292 |

FOREIGN PATENT DOCUMENTS

| | | |
|---|---|---|
| JP | 95-078590 | 3/1995 |
| JP | 9-306418 | 11/1997 |

OTHER PUBLICATIONS

Rapid Communications in Mass Spectrometry, vol. 8, 1994, "Ion–trap Mass Spectrometry with an Inductively Coupled Plasma Source", C. Barinaga et al, pp. 71–76.

* cited by examiner

*Primary Examiner*—Jack Berman
*Assistant Examiner*—Nikita Wells
(74) *Attorney, Agent, or Firm*—Mattingly, Stanger & Malur, P.C.

(57) ABSTRACT

Plasma ion source mass spectrometers or liquid chromatograph/mass spectrometers are provided: wherein photon noises and matrix molecule ions produced by the ion source are decreased, the decrease of the quantity of signal is suppressed, and the apparatus maintenance is improved. The photon noises are decreased with a shielding plate and a 90 degrees deflector. The maintainability in cleaning is improved by a combination of a leading electrode, the shielding plate having a small hole, and a gate valve. The decrease in the quantity of signal is suppressed with the leading electrode, and a double cylindrical type static lens. Position adjustment of the leading electrode is performed with a flat plate having plural holes. Using an ion trap mass analyzer, matrix molecule ions are eliminated by applying a resonance voltage between its end cap electrodes. Decrease in the quantity of signals, which has been a problem, can be prevented, and a high transmission can be realized with a preferable reproducibility against disturbance of an electric field caused by ion lens and the like. A detectable limit of atomic ions of the sample can be improved by eliminating the matrix molecule ions.

15 Claims, 13 Drawing Sheets

MASS SPECTROMETER

BACKGROUND OF THE INVENTION

The present invention relates to mass spectrometers, which are important in analytical field, in particular, to plasma ion source mass spectrometers and liquid chromatography/mass spectrometers.

A plasma ion source mass spectrometer, wherein a sample is introduced into plasma at a high temperature and ionized by heat of the plasma, has been used in the field of chemical element analysis. Any of inductively coupled plasma and microwave plasma can be utilized for the ion source.

A conventional plasma ion source mass spectrometer is explained briefly referring to FIG. 21, hereinafter.

A liquid sample in a sample bottle 1 is nebulized in a spray chamber 2, and ionized by introducing into plasma 3. The generated ions are introduced into a differential pumping region 34 (approximately one Torr), which is pumped by a rotary pump 124, via a sampling cone 4. The ions entered the differential pumping region 34 are introduced into a vacuum region 35 (lower than approximately $10^{-4}$ Torr.), which is pumped by a turbo molecule pump 125, via a skimmer cone 5. Orbits of the ions passed through a gate valve 8 are collimated by ion lenses 22*a,* 22*b,* 22*c,* and an entrance aperture 19 in the vacuum region 35. Subsequently, the ions are deflected by 90 degrees using a deflector composed of quarterly split cylindrical electrodes 10*a,* 10*b,* 10*c,* and 10*d* (hereinafter, this deflector is called Q-deflector) for separating the ion from photon, which is a main source of noises. Then, collimation of the ions is improved by correcting electrodes 16*a* and 16*b,* and the ions are introduced into the mass analyzer 14 for performing mass separation, and detected by a detector 15.

In accordance with using the Q-deflector as explained above, the photons and neutral molecules generated by the plasma are prevented from reaching the detector, and mass spectrum having a preferable ratio of signals versus noises (hereinafter, it is called S/N ratio) can be obtained.

In order to obtain a stable intensity of ions, the pressure in the vacuum region, wherein the mass analyzer is arranged, must be stabilized. Because it takes approximately one hour for stabilizing the pressure in the pressure chamber of the vacuum region 35 from start of pumping, the turbo molecule pump 125 for pumping the vacuum region 35 is preferably not stopped.

On the other hand, the pressure in the differential pumping region 34 can be stabilized in approximately one minute, because its reached pressure of pumping is relatively high in comparison with the pressure of the vacuum region. Therefore, a leading electrode 23 provided with an aperture having a shielding function to prevent neutral particles from entering is arranged between the gate valve 8 and the skimmer cone 5. In order to restrict a portion to be contaminated in the vacuum region, the major portion of the neutral particles generated in the ion source are adhered to the leading electrode 23. If the electrode is contaminated, an insulating film is formed and a charging phenomenon is occurred, and an electric field for transmitting the ions effectively is disturbed. Maintenance of the apparatus can be performed with pumping the vacuum region continuously by shutting the gate valve and cleaning the leading electrode 23. Therefore, the time necessary for re-start up of the apparatus can be shortened.

The conventional plasma ion source mass spectrometer described above was disclosed in JP-A-7-78590 (1995) and JP-A-9-306418 (1997).

Currently, an apparatus, wherein a plasma ion source and a quadrupole ion trap mass spectrometer (hereinafter, called ion trap) are combined, has been used. The apparatus disclosed in "RAPID COMMUNICATIONS IN MASS SPECTROMETRY" vol. 8, 71–76 (1994) is explained hereinafter referring to FIG. 22.

Ions generated by plasma are led to the first differential pumping region 36, which is being pumped by a rotary pump 124, and subsequently, the ions are introduced into the second differential pumping region 37 by a leading electrode 26. After passing through the gate valve 8, the ion orbits, which have been scattered by a photon shielding electrode 27 called as a photon stopper, are collimated by ion lenses (28*a,* 28*b*), and introduced into the vacuum region 35. The ions are collimated again with the ion lenses (29*a,* 29*b,* 29*c*), and introduced into the quadrupole mass spectrometer 30. In accordance with the quadrupole mass analyzer 30, ions having a specified mass number can be transmitted selectively. Subsequently, the ions are collimated with the ion lenses (31*a,* 31*b,* 31*c*), and introduced into the ion trap mass analyzer 14. The ions are detected by the detector 15 after being separated depending on their masses.

In the field of organic substance analysis, a liquid chromatograph/mass spectrometer (hereinafter, called LC/MS), which is composed by combining a liquid chromatograph and a mass spectrometer, has been used frequently. In accordance with the LC/MS, ions are separated from neutral particles such as micro-droplets and the like for increasing a S/N ratio. A conventional example of the LC/MS has been disclosed in U.S. Pat. No. 5,481,107.

In accordance with the conventional plasma ion source mass spectrometer, noises can be decreased, because entering the neutral particles is prevented by reducing a part of the leading electrode 23 for decreasing a sighting angle, or using the photon stopper 27 on the axis of the skimmer cone. On the other hand, a problem to decrease ion transmission is generated. In some cases, reproducibility of the ion transmission can not be obtained, because of errors in assembling the lenses after cleaning.

Generally, the gate valve 8 is electrically grounded. Therefore, the ions move slowly at this region, and the ions are readily effected by unintentional seeping of electrical field (called fringing field) from the electrode arranged in the vicinity of the gate valve. Generally, the unintentional electrical field is formed asymmetrically to the central axis of the lens. Accordingly, the ion lenses 22*a,* 22*b,* 22*c,* which are axially symmetrical, and an entrance aperture 19 have a problem to decrease the ion transmission by collimating the ion orbit insufficiently.

Furthermore, the conventional plasma ion source mass spectrometer indicated in FIG. 21 was composed of two pairs of flat plates, each of the pairs faced each other (16*a,* 16*b,* and a pair of plates arranged at above and beneath this paper, which are not indicated in the figure), as correcting lenses for introducing the ions into the mass analyzer after the ions were deflected. That is, a moving direction of the ions is corrected and collimated by giving a potential gradient in a direction perpendicular to the moving direction of the ions deflected by the deflector. Therefore, because the most optimum voltage of the correcting electrodes 16*a,* 16*b* depends strongly on kinetic energy of the ions, collimating the ions is difficult with the plasma ion source mass spectrometer, which has a large fluctuation in the kinetic energy of the ions.

That is, it is an issue that increasing the efficiency of the ion transportation by how eliminating particles other than the ions during introducing the ions from the ion source to the mass spectrometer for analyzing the ions. Therefore, the ion transport region for introducing the ions into the ion mass spectrometer has a fundamental composition, wherein the ions are introduced into the analyzing region after the ion orbit is remarkably bent in the ion transport region.

In some cases, reproducibility of the ion transmission can not be obtained, because of errors in assembling the lenses after cleaning.

In accordance with the conventional mass spectrometer, it is a problem that molecule ions such as $ArOH^+$ and $NOH^+$ are generated from argon gas or nitrogen gas used as a carrier gas for sample or plasma gas, and these molecule ions disturb the measurement by overlapping with peaks of atomic ions of the measuring object.

In accordance with the ion trap mass analyzer, it is a problem that an error in the measurement is generated by decreasing the number of the measuring object ions by reacting the ions in the mass analyzer with impurities caused by vacuum pump oil and the like during storing the ions for several to hundreds ms before the analysis.

SUMMARY OF THE INVENTION

The first object of the present invention is to provide a mass spectrometer having a high S/N ratio by a high ion transmission and effective elimination of neutral components.

The second object of the present invention is to improve accuracy in assembling the ion lenses.

The third object of the present invention is to provide a mass spectrometer, wherein effects of molecule ions are reduced.

The fourth object of the present invention is to improve an accuracy in measurement by controlling undesired reactions in the mass spectrometer.

In accordance with the present invention, the mass spectrometer comprising: an ion source arranged in a first chamber under a first pressure condition; an orifice for introducing ions generated in the ion source into a second chamber under a second pressure condition, which is lower than the first pressure condition; an ion transport region for transporting the ions introduced into the second chamber through the orifice to a desired region; and a mass analyzer for analyzing the ions transported through the ion transport region by mass spectrometry; wherein a gate valve is provided between electrodes composing the ion transport region, a shielding plate having a small opening is provided between the orifice and the gate valve, and a leading electrode for collimating the ions is provided between the orifice and the shielding plate; is used for solving the above problems.

In order to increase the accuracy in assembling the leading electrode and the shielding plate, the leading electrode and the shielding plate are fixed on a flat plate having plural openings. A differential pumping region under a third pressure condition, which is intermediate between the first pressure condition and the second pressure condition, is provided between the first chamber and the second chamber. For the above ion source, any one of plasma ion source, electrospray ion source, atmospheric chemical ionization ion source, and sonicspray ion source can be used. The ion trap mass analyzer can be used as the above mass analyzer. The ion transport region can be composed of ion collimating lenses and a deflector. A double cylindrical static lens can be used for any one of the ion collimating lenses. In accordance with the deflector, the ion orbit can be deflected by approximately 90 degrees. The deflector can be composed of plural sector-shaped electrodes. The deflector may be a quadrupole deflector composed of quarterly split cylinder-shaped electrodes. In order to eliminate molecule ions, a power source for applying high frequency waves of desired frequencies is provided between a pair of end-cap electrodes composing the ion trap mass analyzer. The distance between the end-cap electrodes can be set longer than 20 mm. The end-cap electrode comprises an opening, and the diameter of the opening can be set larger than 2 mm. An oil-free scroll pump can be used for pumping the differential pumping region.

In accordance with the mass spectrometer of the present invention, the ions of the measuring object are detected by introducing into the mass analyzer through the leading electrodes and ion lenses after passing through the skimmer cone. The photons and neutral molecules generated by the plasma are adhered to the shielding plate having a small opening at a portion out of the moving direction of the ions. Because the major portion of the neutral molecules are adhered to the shielding plate, the contamination can be prevented at the mass analyzer side from the gate valve side. In accordance with suppressing the contamination, the disturbance of the electric field can be prevented, and the ion transmission can be readily maintained high. Because the shielding plate is located before the gate valve, maintenance such as cleaning and the like can be performed without stopping operation of the vacuum pump for the vacuum region. Therefore, re-measurement after cleaning can be performed easily. Furthermore, the neutral molecules and photons passing through the shielding plate can be separated from the ion orbits by deflecting the ions approximately 90 degrees by the deflector. In order to maintain the high ion transmission with such ionic optical system as described above, ion lens (static lens) composition and its assembling method were improved, and the leading electrodes and the shielding plate were fixed onto the flat plat having plural openings. Accordingly, the errors in assembling the ionic optical system could be decreased, and the reproducibility of the ion transmission could be improved. In accordance with the present invention, a function to control the kinetic energy of the ions introduced into the mass analyzer could be realized, and significant improvement in the S/N ratio was realized by remarkable improvement in the efficiency of ion accumulation into the ion trap mass analyzer.

The measurement with a high sensitivity became possible by separating the atomic ions of the measuring object from matrix molecule ions by using ion trap mass analyzer for the mass analyzer of the plasma ion source mass spectrometer, and performing operations such as applying a resonance voltage between the end-cap electrodes, and others.

DESCRIPTION OF THE PREFERRED EMBODIMENTS

Hereinafter, embodiments of the present invention are explained in detail referring to figures.

Figure 1:
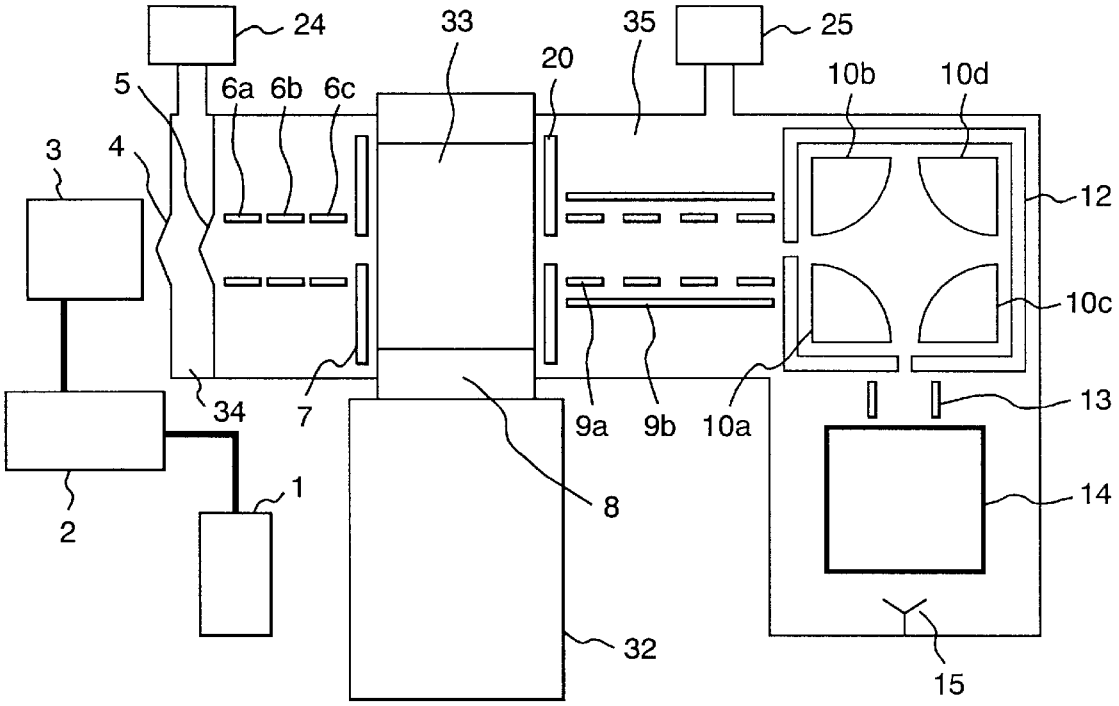
FIG. 1 is a schematic axial cross section indicating the first embodiment of the present invention.

FIG. 1 is a schematic axial cross section indicating the first embodiment of the present invention. A plasma ion source mass spectrometer which requires to separate ions from photons, which are main causes of noises, is indicated.

Even in case of a liquid chromatograph/mass spectrometer, the fundamental philosophy to improve a S/N ratio by separating the ions from electrically neutral particles (photons or micro droplets), which are causes of noises, and to improve maintainability by preventing the micro droplets from entering inside the mass spectrometer from the gate valve region is as same as the mass spectrometer, although the micro droplets entering the vacuum region are the eliminating objects instead of the photons.

Figure 10:
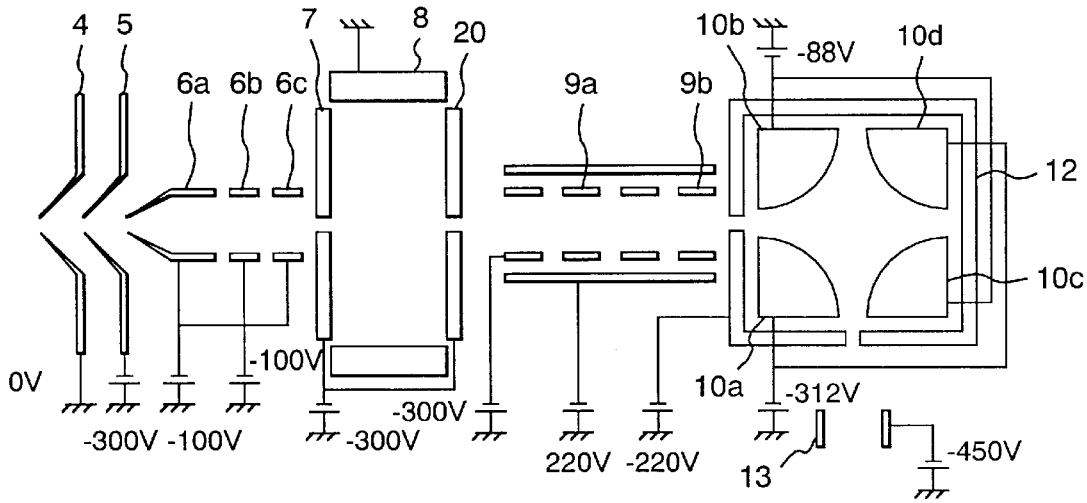
FIG. 10 is a schematic wiring diagram indicating wiring to the respective electrodes.

Wiring from power source to respective electrodes are indicated in FIG. 10. A part of the liquid sample in a sample bottle 1 is nebulized in a spray chamber 2, and ionized by introducing into inductively coupled plasma or microwave induced plasma 3. The generated ions are introduced into a differential pumping region 34, which is being pumped to approximately 1 Torr. by a roughing vacuum pump 24 having a pumping speed of hundreds liters/minute through a sampling cone 4 having an inner diameter of approximately 0.8 mm.

For the roughing vacuum pump 24, an oil-free scroll pump is desirably used. In accordance with using the oil-free scroll pump, contamination of the differential pumping region 34 with oil can be prevented, and frequency of cleaning the electrodes can be decreased. Furthermore, because the oil is not entered the vacuum region 35, reactions in the mass analyzer 14 are suppressed, and an intake of the ions into the ion trap mass analyzer for a long time (more than 50 ms) becomes possible. If a rotary pump is used for pumping the differential vacuum region 34 in a case when the ions stay for a long time in the mass analyzer 14 such as the ion trap mass analyzer, oil and the like are entered inside the mass analyzer, and sometimes an accurate quantitative value can not be obtained due to the reaction of the oil and the like with the ions of the measuring object. Because a signal value is proportional to the intake time of the ions into the ion trap mass analyzer, extending the intake time of the ions is effective for improving sensitivity. As the result of using the oil-free pump for pumping the differential pumping region 34, the intake time of the ions could be extended, and the signal value is increased.

The ions entered the differential pumping region 34 are led out by the electrode 6*a* through a skimmer cone 5 having a small hole of approximately 0.4 mm in inner diameter. Then, the ions are collimated to the small hole portion of a shielding plate 7 by static lenses (6*a*, 6*b*, 6*c*), and introduced into the gate valve 8. The gate valve 8 requires a space for storing the gate portion when the valve is in an open state. In accordance with the present analyzer, the gate storing portion 32 was arranged in a direction where the mass analyzer was set, because a portion of the vacuum chamber where the mass analyzer 14 was arranged was protruded horizontally in order to deflect the ion orbit by 90 degrees. Accordingly, a composition to save the space became possible.

For the shielding plate 7 at lens side from the gate valve 8, a shielding plate, which covered the opening portion 33 of the gate valve 8 and had a small hole (inner diameter was 1–3 mm) at its center, was used. The shielding plate has an advantage to eliminate noise sources having a straight moving property such as photons and the like generated by plasma. Furthermore, an advantage to improve maintainability can be achieved by restricting the contamination of the electrodes, which is assumed to be caused by the neutral molecules, at atmospheric side from the gate valve 8. The transmission T of the straight moving particles through the respective lenses can be expressed by the following equation 1:

$$T\ \Omega\ r^2/I \qquad \text{(Equation 1)}$$

where, Ω is a solid sighting angle from the skimmer cone, r is an inner diameter of the electrode, and I is the distance from the skimmer cone to the shielding plate.

Figure 7:
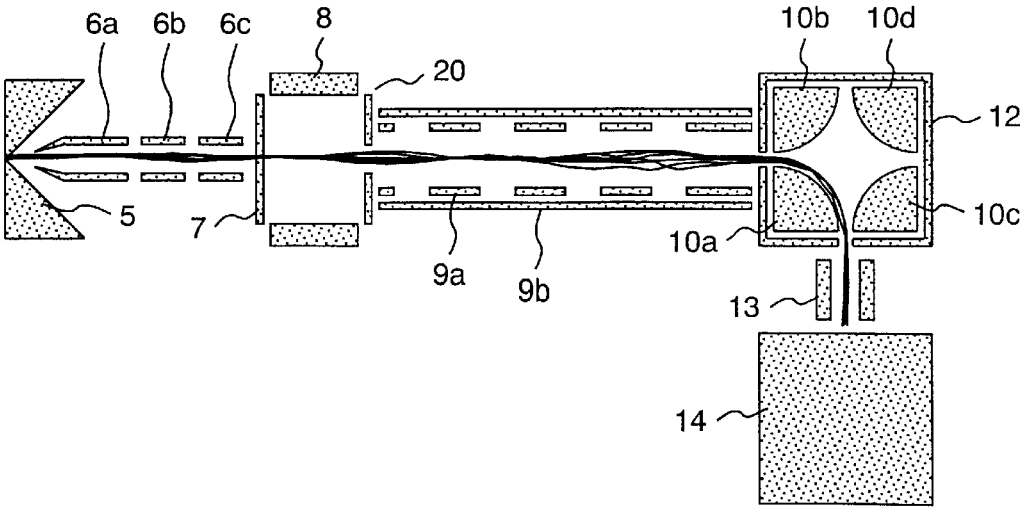
FIG. 7 is an illustration indicating an ion orbit in the embodiment of the present invention.
Figure 8:
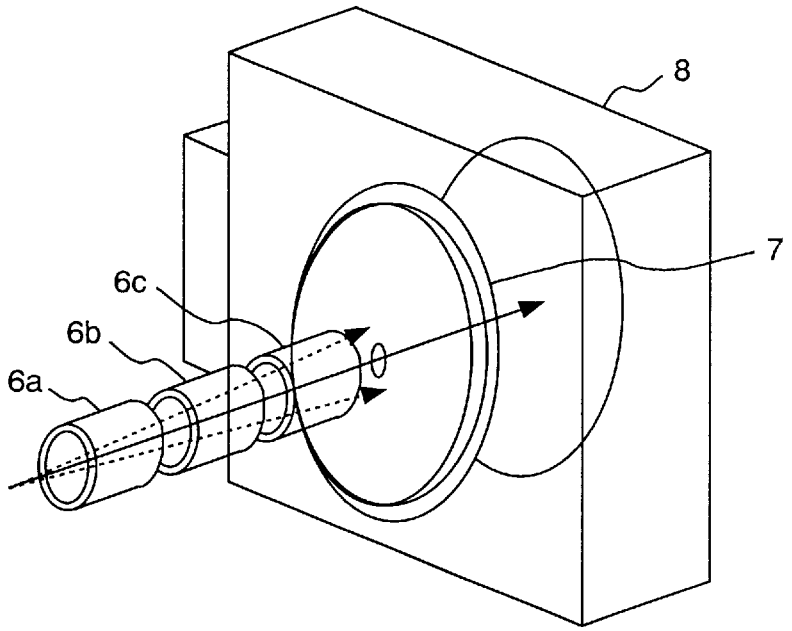
FIG. 8 is a perspective view indicating an example of the shielding plate.
Figure 9:
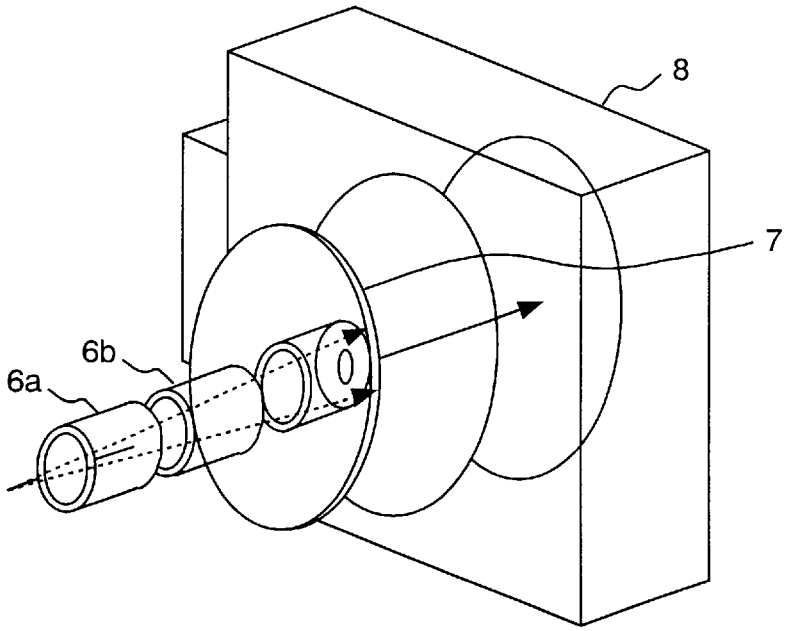
FIG. 9 is a perspective view indicating one of other examples of the shielding plate.
Figure 20:
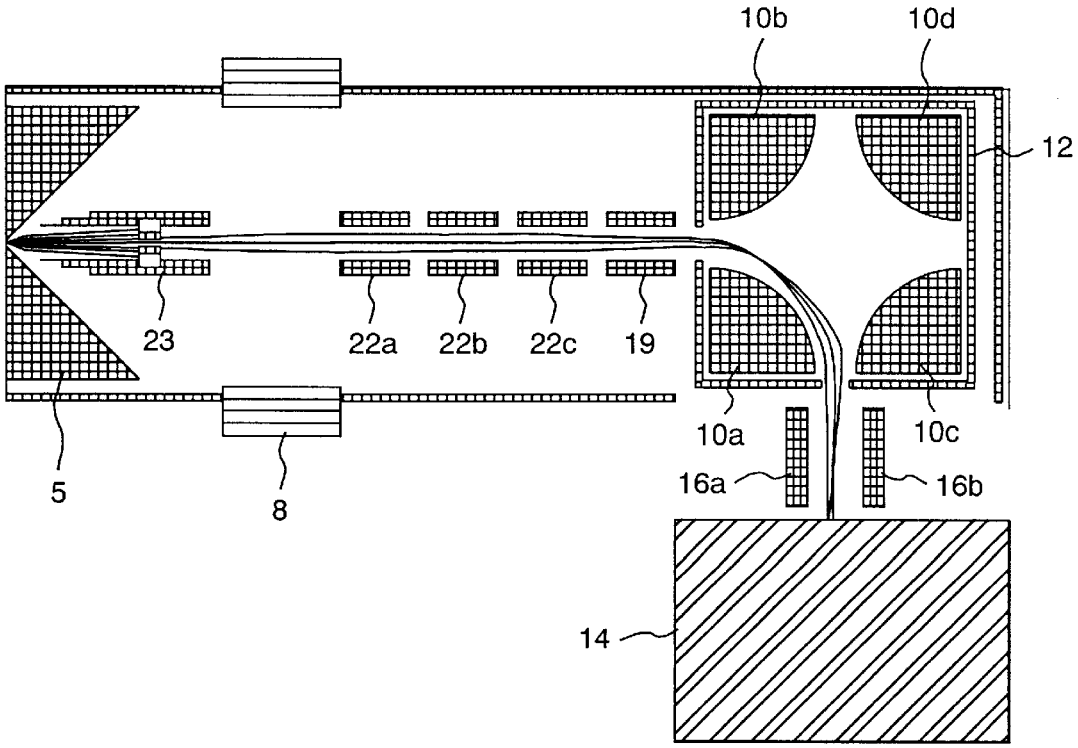
FIG. 20 is an illustration for explaining the ion orbit of a conventional plasma ion source mass spectrometer.

When the inner diameter is equal, the transmission of the noise sources can be decreased by the present invention, because the distance I from the skimmer cone to the shielding plate of the present invention becomes longer than that of the conventional example. However, if the quantity of the ion is decreased such as the conventional example, the S/N ratio is not significantly improved. Then, in accordance with the present invention, static lenses (6*a*, 6*b*, 6*c*) were used, in order to prevent reduction of the signals. The values of voltage applied to respective static lenses (6*a*, 6*b*, 6*c*) were set so as to make the ion orbit focus to the small hole of the shielding plate 7. FIG. 7 indicates a result of calculation of the ion orbits in the present embodiment. FIG. 7 shows the orbits of the ions projected from the skimmer cone 5 with the energy of 10 eV in a vertical direction with an angle from −30° to 30° at every ten degrees. At that time, the diameter of the small hole in the shielding plate 7 was 2 mm, but all the ions passed through the shielding plate 7. On the other hand, the calculated result of the ion orbits with the conventional composition is indicated in FIG. 20. Because a part of the ions do not pass through the leading electrode, the ion signal is reduced. As explained above, the reduction of ion signal could be prevented by using the leading electrodes 6*a,* 6*b,* 6*c* as lenses and focusing the ion orbits to the small hole of the shielding plate 7. In accordance with the embodiment indicated in FIG. 1, three split electrodes (6*a,* 6*b,* 6*c*) are used as the leading electrodes, in order to make the distance from the skimmer cone long for reducing the noises explained above. However, if at least an electrode which can apply a voltage independently exists at the skimmer cone 5 side from the shielding plate 7, it is possible to focus the ions to the vicinity of the opening of the shielding plate. Because the straight moving noise can be decreased by the reason described above, a S/N ratio higher than the ratio of the conventional composition can be realized. Regarding the shape around the shielding plate, a shape wherein one of the leading electrode and the shielding plate are combined to form a body as indicated in FIG. 9 is effective, in addition to the shape indicated in FIG. 1 and its perspective view in FIG. 8. These electrodes have a shape to cover approximately the opening of the gate valve as shown in the figures. Accordingly, adjustment of the electrode voltage was facilitated, because the electric field in the gate valve 8 became independent from the voltage of the electrodes (6*a,* 6*b,* 6*c*). Pumping gas in the region at the skimmer cone 5 side from the gate valve is performed mainly through an interval between the shielding plate 7 and the gate valve 8. Therefore, a neutral gas stream outward from the center of the electrodes (6*a,* 6*b,* 6*c*) is generated, and contamination of the electrodes (6*a,* 6*b,* 6*c*) is prevented.

Because the sighting angle can be reduced by decreasing the diameter of the hole in the shielding plate 7, and contaminants such as neutral particles and the like introduced through the hole of the shielding plate 7 are decreased, the frequency of cleaning which requires to stop pumping in a region at the vacuum region side from the gate valve 8 can be decreased significantly. Because the shielding plate 7 was contaminated readily and required frequent cleaning, it had a detachable structure.

Figure 4:
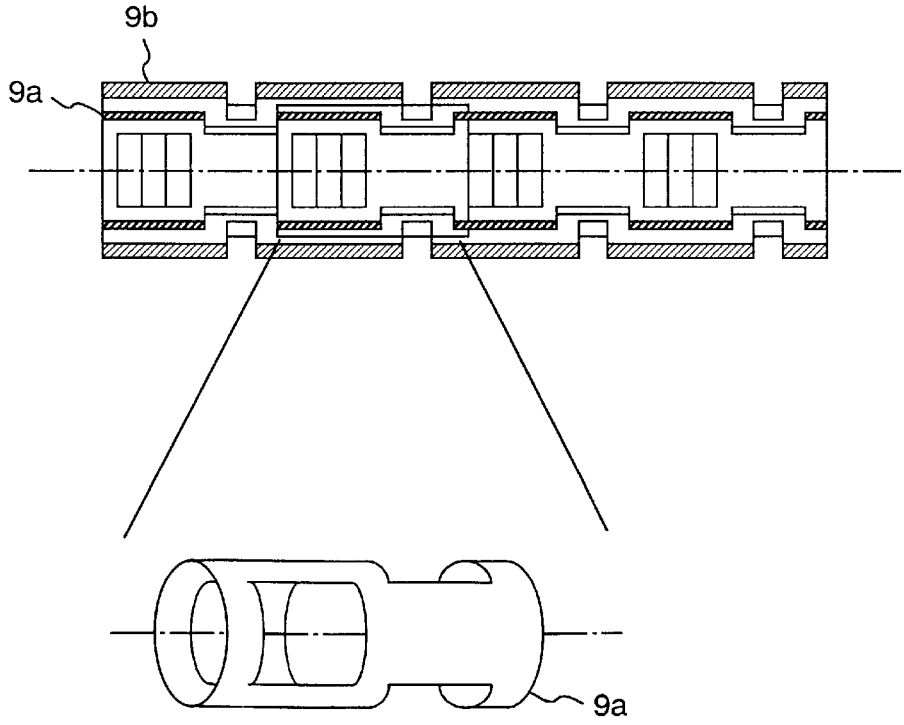

In order to collimate the ion orbits spread by the fringing field described previously, double cylindrical lenses 9*a* and 9*b* were provided between the gate valve 8 and the deflector composed of the electrodes 10*a,* 10*b,* 10*c,* and 10*d.* The double cylindrical type static lens composed of the electrodes 9*a* and 9*b* has an effect to collimate the ions by an electric field of the outer cylindrical electrode 9*b* seeping inward through plural openings of the inner cylindrical electrode 9*a*. An axial cross section of the double cylinder type static lens 9 and an example of the openings provided to the inner cylindrical electrode 9*a* are indicated in FIG. 4. In accordance with providing plural openings in the direction of the central axis of the inner cylindrical electrode 9*a* with various phases and various intervals in the axial direction of the cylindrical electrode, the electrical field of the outer cylindrical electrode 9*b* seeped out from the openings has a roll to collimate the ions three-dimensionally (a function to collimate the ions by pushing back the ions to the direction of the central axis of the cylinder). In accordance with FIG. 4, openings are also provided to the outer cylindrical electrode 9*b*. These openings are paths of gas for improving vacuum in the interior of the double cylindrical type static lenses.

In accordance with FIG. 1, a static lens 20 is inserted between the double cylindrical lens 9 and the gate valve 8 so as to close the opening 33 of the gate valve. The roll of the static lens 20 is to prevent the ion orbits from being effected by the electrical field of the double cylindrical lens 9 which is seeped into inner portion of the gate valve 8.

Figure 2:
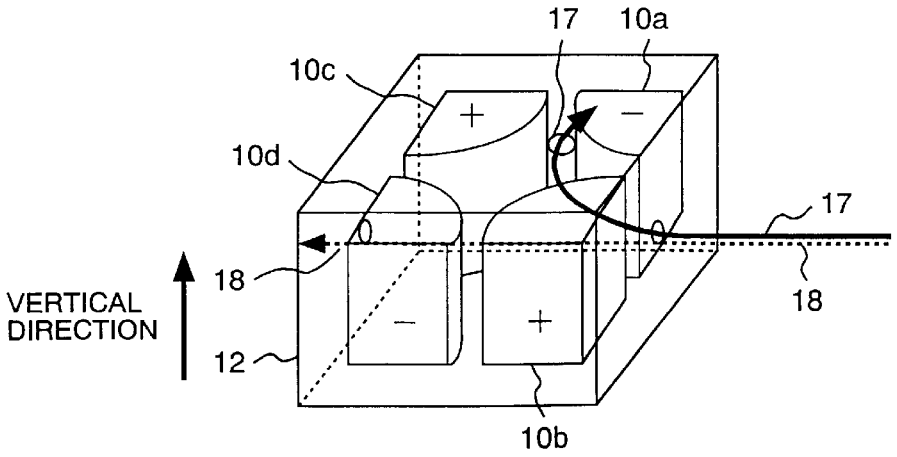
FIG. 2 is a perspective view indicating an example of the deflector.
Figure 3:
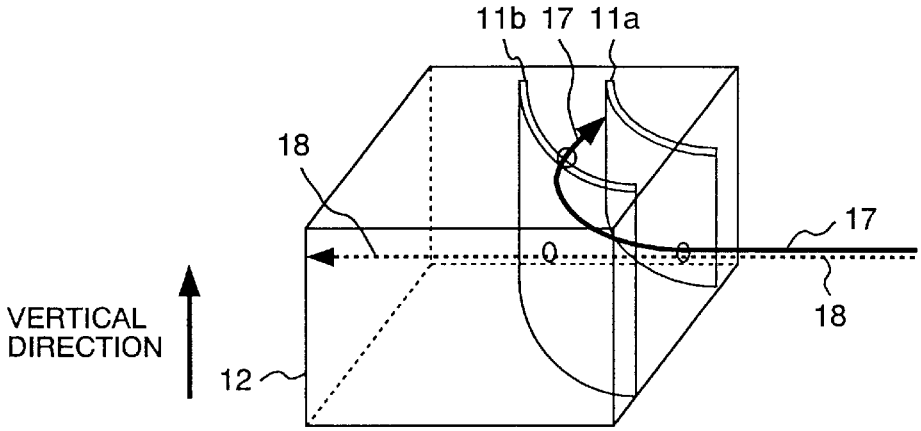
FIG. 3 is a perspective view indicating one of other examples of the deflector, FIG. 4 are an axial cross section indicating a double cylinder type static lens and a perspective view indicating the shape of its opening.

For the deflector, any of deflector composed of four quartered rods or cylindrical electrodes 10*a,* 10*b,* 10*c,* 10*d* as indicated in FIG. 1 and FIG. 2, and composed of a pair of sector-shaped electrodes 11*a,* 11*b* as indicated in FIG. 3 and the like can be used. These deflectors themselves are readily effected by the fringing field because these deflectors are open to the vacuum chamber in the vertical direction (indicated in FIG. 2 and FIG. 3). In order to suppress the effect, a whole body of the deflector is covered with a deflector box 12. Small holes are provided to the deflector box 12 at portions in the directions of entering the ions and projecting the ions. Entering the reflected photons into the detector can be prevented by providing a hole at a portion in the moving direction of the photons, in order to prevent the photons from reflecting irregularly. When using a deflector composed of a pair of sector-shaped electrodes, it is necessary to provide a hole for eliminating straight moving photons at a portion of the electrode. The region where the deflector exists is pumped to a vacuum of $1\times10^{-4}$ to $1\times10^{-5}$ Torr. by a turbo molecule pump and the like.

Figure 21:
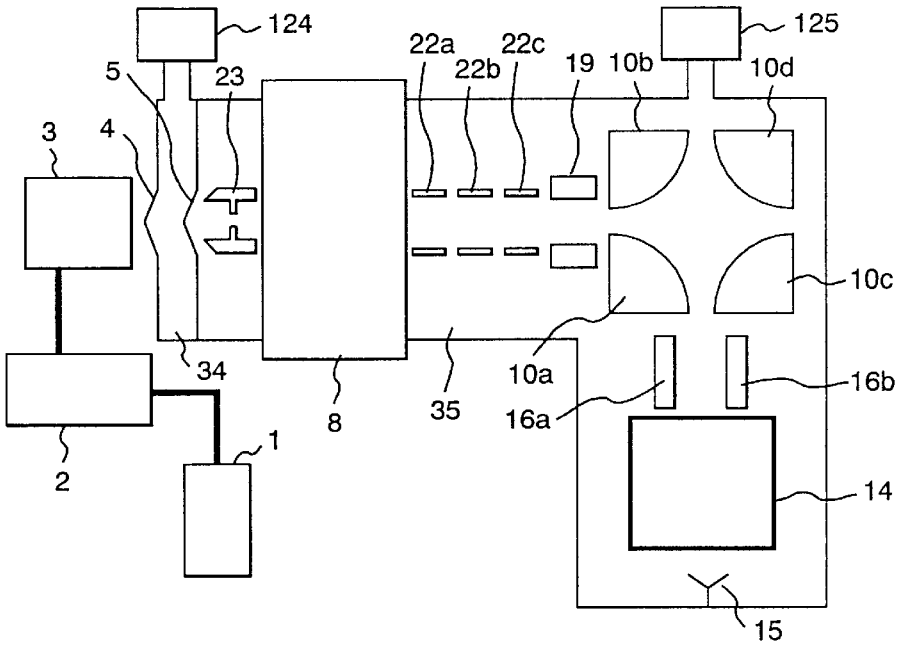
FIG. 21 PRIOR ART
FIG. 21 is a schematic axial cross section indicating composition of the conventional plasma ion source mass spectrometer.
Figure 22:
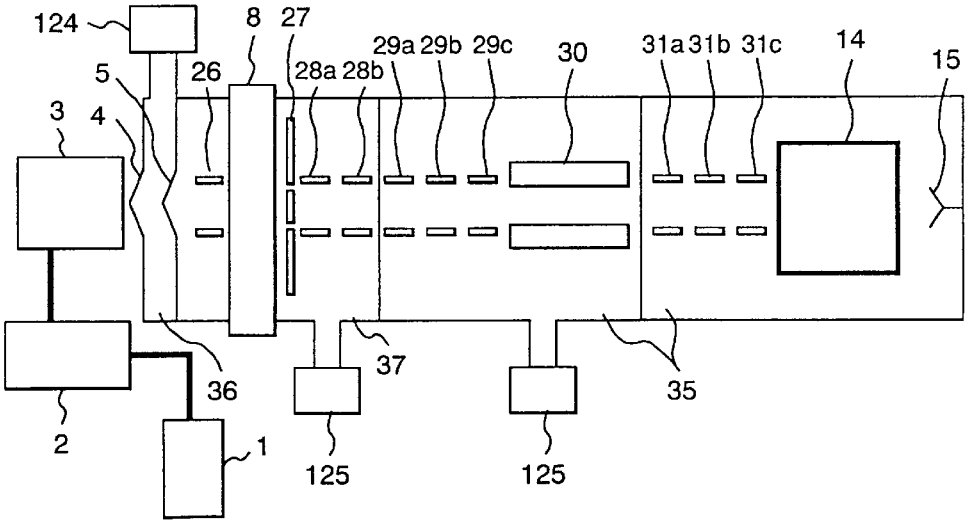
FIG. 22 PRIOR ART
FIG. 22 is a schematic axial cross section indicating composition of the conventional plasma ion source mass spectrometer.

In accordance with FIG. 1, the ions passed through the deflector are collimated by the static lens 13, and entered the mass analyzer 14. A correcting electrode in the prior art such as indicated in FIG. 21 is not necessarily required, because collimating properties of the ions at the entrance and exit of the deflector by the double cylindrical type static lens composed of 9*a* and 9*b* are excellent.

Figure 5:
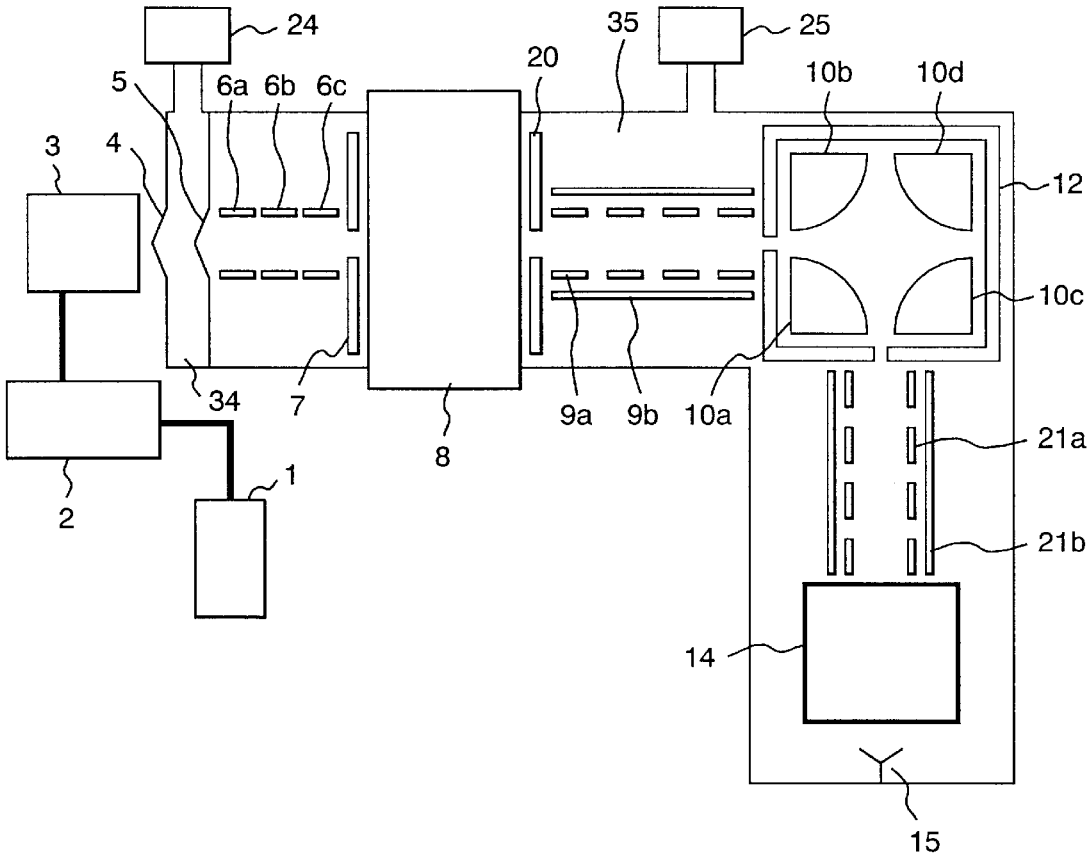
FIG. 5 is a schematic axial cross section indicating the second embodiment of the present invention.

Instead of the static lens 13, the double cylindrical type static lens can be used at this portion, as indicated in FIG. 5 as the second embodiment of the present invention. In this case, the collimating property of the ions, which enter the mass analysis region 14, is improved further.

Figure 6:
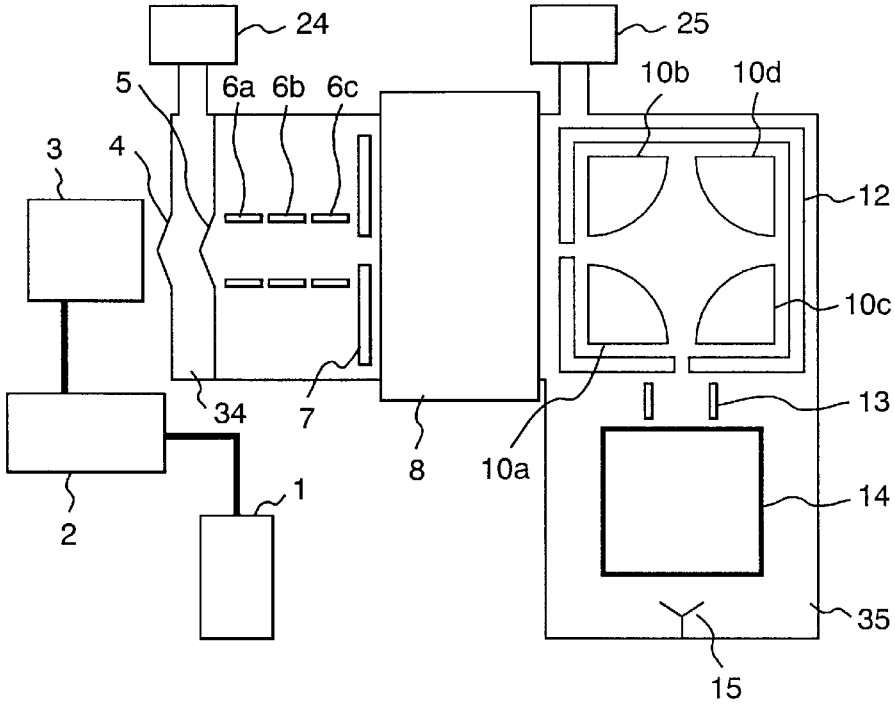
FIG. 6 is a schematic axial cross section indicating the third embodiment of the present invention.

It is possible to omit the double cylindrical type static lens composed of 9*a* and 9*b* from the composition indicated in FIG. 1. That composition is indicated as the third embodiment of the present invention in FIG. 6. In this case, an advantage to reduce a production cost is achieved, because the number of the electrodes can be decreased.

Figure 17:
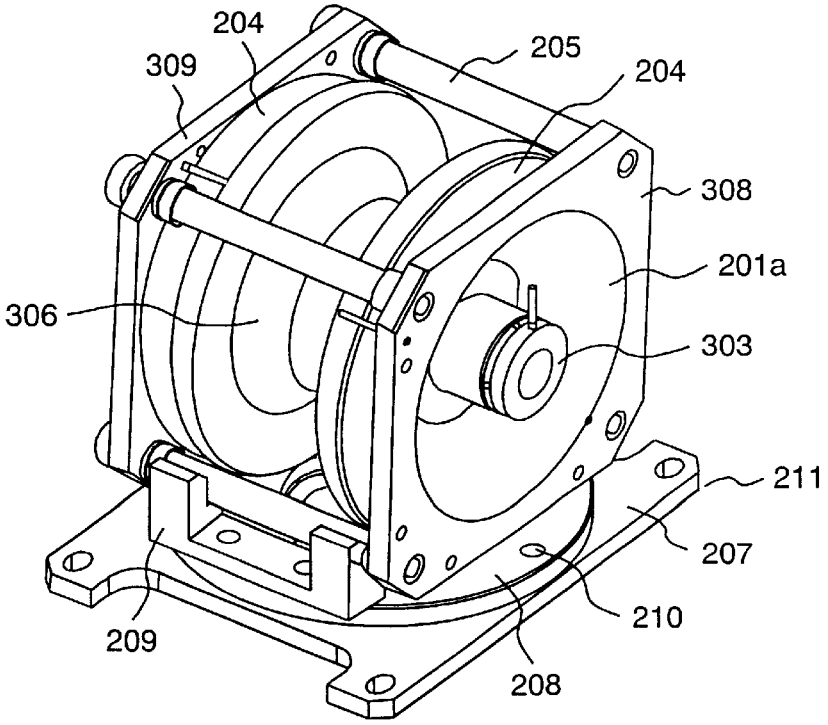
FIG. 17 is a perspective view of the ion trap mass analyzer (mass analysis region) and the holder indicating their assembled state.
Figure 18:
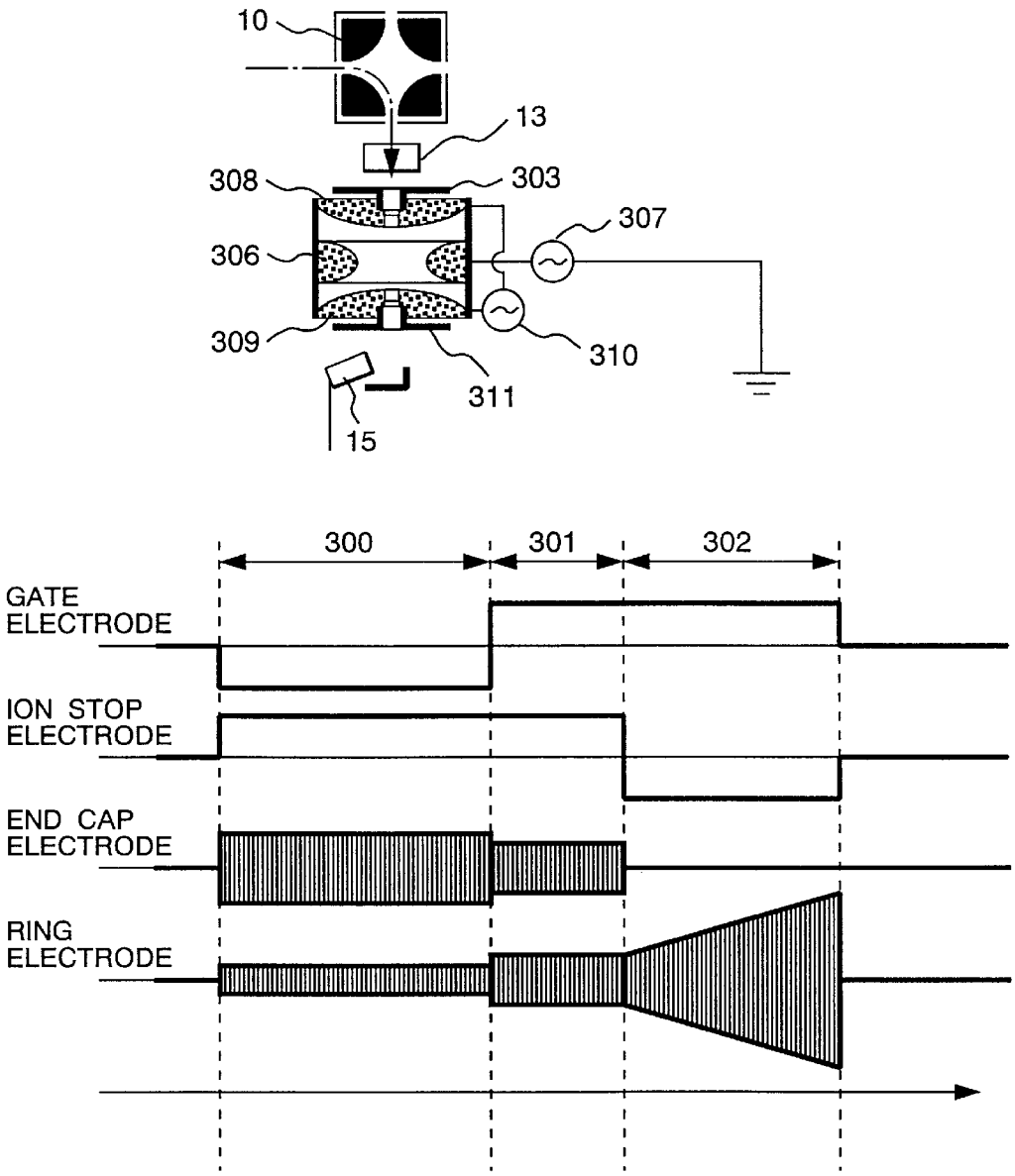
FIG. 18 is a set of graphs for explaining applied voltages to respective electrodes of the ion trap mass analyzer (mass analysis region)

The ions collimated by the static lens 13 are entered the mass analyzer 14. The mass analyzer used here can be any one of an ion trap mass analyzer, wherein the ions are separated based on their mass by scanning in a high frequency electric field after being accumulated in a space surrounded by a pair of end cap electrodes and a ring electrode for a designated time, a quadrupole mass-separator, wherein the ions are separated based on their mass by applying a high frequency voltage to four rods, and the like. A perspective view and a composition of the ion trap mass analyzer are indicated in FIG. 17 and FIG. 18, respectively. Particularly, in accordance with the ion trap mass analyzer, a square of shortest distance of the end cap electrodes 308 is almost inversely proportional to the detectable maximum mass number of the ions, when the voltage applied to the ring electrode 306 is fixed. Therefore, if the ions of the measuring object are limited to elementary ions, and the mass number of the ions to be measured is restricted to utmost 250, such as a plasma ion source mass spectrometer, it is not a problem even if the ions having a mass number larger than 250 can not be measured by enlarging the distance between the end cap electrodes 308 and 309, and a radius of inscribed circle of the ring electrode 306. The conventional ion trap mass analyzer had a problem that, if the size of the entrance orifice or exit orifice of the ions provided to the end cap electrodes 308, 309 was enlarged, a distortion of electric field in the electrode was generated, and an efficiency of ion measurement accumulation were decreased. If the size of the hole is reduced, a problem that the ions could not pass the small hole of the end cap electrodes 308, 309, and a quantity of the ions were decreased. When the sizes of the end cap electrodes 308, 309, and the ring electrode 306 were increased, the electric field was not disturbed even if the diameter of the small hole was made larger than 2 mm. As the result, it became possible that the accumulation and discharge of the ions could be performed with no decrease in the quantity of the ions. In accordance with the conventional ion trap mass analyzer, there was a phenomenon called space charge, which means undesired influence given to resolution at the measurement accumulation of the ions by saturation of the ions in the electrodes. The maximum quantity of the ion accumulation, which is not effected by these undesired influence, is increased with increasing the size of the ion trap. In a case when the maximum voltage which can be applied to the ring electrode 306 is assumed to be 10 kV(p.p.), the minimum distance between the end caps can be increased to 20 mm, if the mass range is at 250 or less. This size is approximately 1.5–2 times in comparison with the size of general ion trap being used in conventional gas chromatograph/mass spectrometer, liquid chromatograph/mass spectrometer, and the like, and the quantity of ions which can be accumulated becomes 3–6 times. The ions are detected by the detector 15 after being separated based on their masses.

Hitherto, the embodiments applied to the plasma ion source mass spectrometers have been explained. However, the same advantages can be expected with the case of liquid chromatograph/mass spectrometer combined with an atmospheric ionization method; such as electrospray ion sources, atmospheric chemical ionization ion sources, sonicspray ion sources, and the like utilizing an atmospheric pressure chemical phenomenon using corona discharge and subsequent ionic molecule reactions; and a mass analyzer. In this case, micro droplets become the object for elimination instead of photons.

Results of calculation on the ion orbits performed on the cases indicated in FIG. 1 and FIG. 21 in order to study the superiority of the new ionic optical system are indicated in FIG. 7 and FIG. 20, respectively. It is revealed that all the ions are passed in the case indicated in FIG. 7, but a part of the ions are not passed and the transmission is decreased in the case indicated in FIG. 20. Different from the result by the calculation, the transmission of the composition indicated in FIG. 1 using the double cylinder lens composed of the electrodes 9*a* and 9*b* is practically higher than that of the composition indicated in FIG. 21, because asymmetrical electric field is generated by reasons of mechanical accuracy and contamination of the lens.

A method for increasing an ion accumulation efficiency at inside the electrode of the ion trap mass analyzer by providing a potential difference to the end cap electrode 308 and the sampling cone 5 of the ion trap mass analyzer is explained, hereinafter.

Injection energy of the ions has an optimum value for accumulation, and a several eV are regarded as optimum. The ion accumulation efficiency is decreased as the injection energy is away from the optimum value. In accordance with the plasma ion source mass analyzer, the ion source has a plasma potential of approximately 20 eV to the sampling cone 5, and as the result, the ion has a kinetic energy of approximately 10 eV in vacuum. In order to give a potential difference, a minus voltage may be applied to the sampling cone 5.

Figure 11:
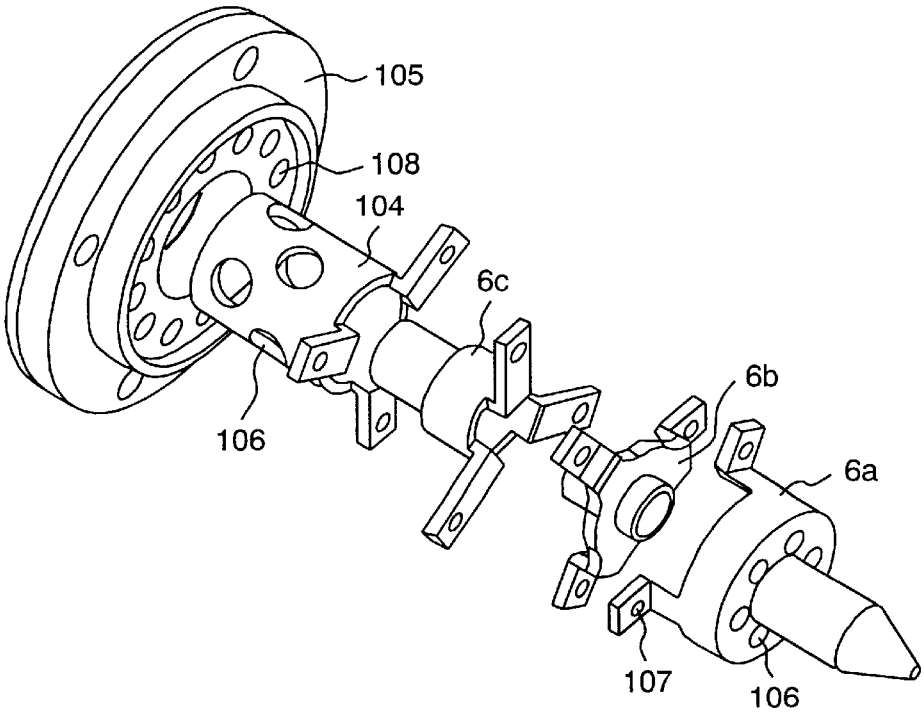
FIG. 11 is a perspective exploded view of an ion lens (static lens) indicating its composition.

If an arranging accuracy of the electrodes composing the leading electrodes 6*a*, 6*b*, 6*c* and the shielding plate 7 is not appropriate, it will become a source to decrease the ion transmission. Therefore, the electrodes must be assembled carefully. The details of the leading electrodes 6*a*, 6*b*, 6*c* and the shielding plate 7 of the present invention are explained referring to FIG. 11 to FIG. 13. These figures indicate a composition, wherein the leading electrodes 6*a*, 6*b*, 6*c*, the shielding plate 7, and the electrode 104 are attached to the insulation maintaining portion 105. FIG. 11 indicates the leading electrodes 6*a*, 6*b*, 6*c*, the shielding plate 7, the electrode 104, and the insulation maintaining portion 105 before assembling. In order to increase an ultimate vacuum in the vicinity of the central axis where the ion passes, an opening 106 for pumping may be provided to the electrode 104. Openings 107 for penetrating screws are provided to the electrode 104, and screw portions 108 for fixing the electrode with screws are provided to the insulation maintaining portion 105. In accordance with these openings 107 and screw portion 108, the electrode is fixed to the insulation maintaining portion 105 with screws.

Figure 12:
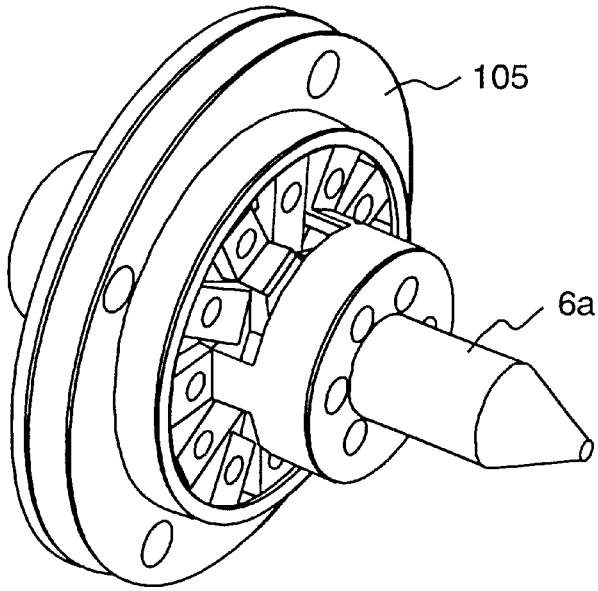
FIG. 12 is a perspective view of the ion lens (static lens) from the leading electrode side indicating its assembled state.
Figure 13:
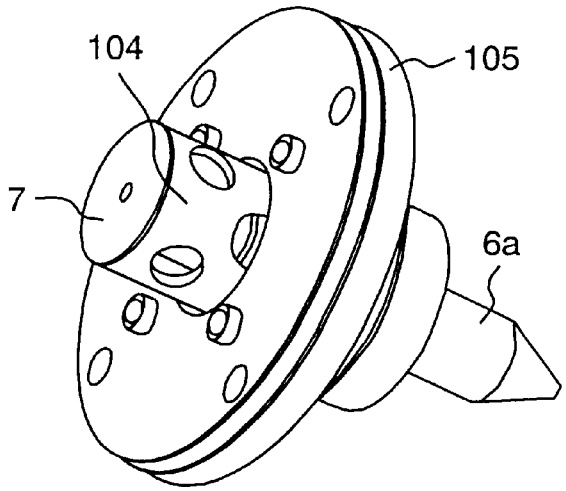
FIG. 13 is a perspective view of the ion lens (static lens) from the shielding plate side indicating its assembled state.

For reference, the leading electrodes 6*a*, 6*b*, 6*c*, the shielding plate 7, the electrode 104, and the insulation maintaining portion 105 after assembling are indicated in figures. FIG. 12 is a perspective view from the sampling cone 5 side where the ions are entered, and FIG. 13 is a perspective view from the gate valve 6 side where the ions are projected. As indicated in FIG. 13, the shielding plate 7 is arranged at an end of ion projection side of the electrode 104.

Details of the shape of the ion trap mass analyzer are explained referring to FIG. 14 to FIG. 17.

Figure 14:
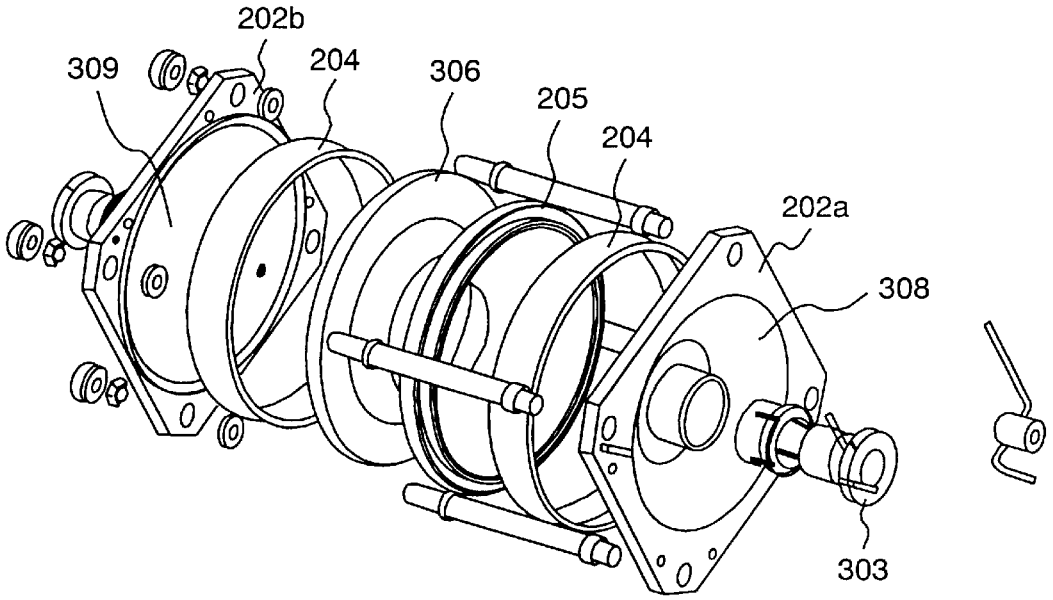
FIG. 14 is a perspective exploded view of an ion trap mass analyzer (mass analysis region)
Figure 15:
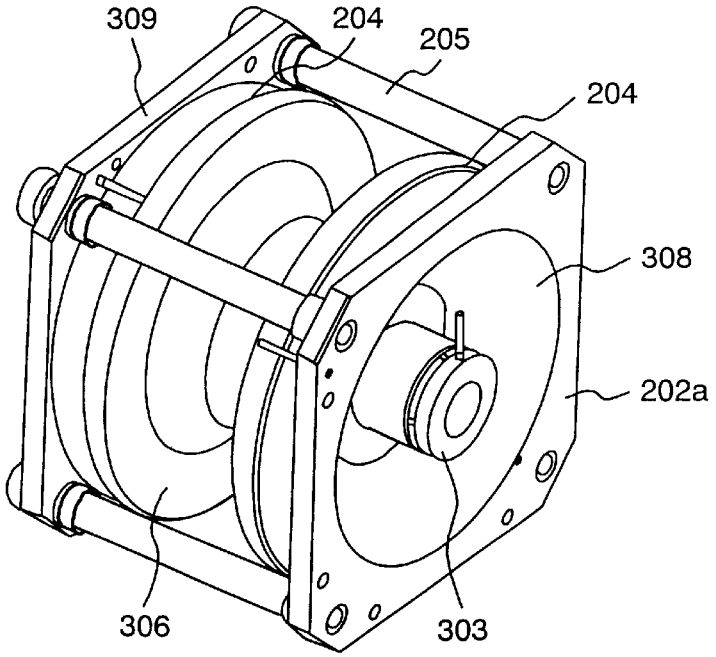
FIG. 15 is a perspective view of the ion trap mass analyzer (mass analysis region) indicating its assembled state.

FIG. 14 is a perspective exploded view of an ion trap mass analyzer indicating the shapes of its components. Each of the end cap electrodes 308, 309 is fixed to the insulating members 202*a*, 202*b*, respectively. The ring electrode 306 is insulated from the end cap electrodes 308, 309 by quartz 204. The insulating members 202*a*, 202*b*, the ring electrode 306, and the quartz 204 are supported by fixing the insulating members 202*a*, 202 with the poles 205. The gate electrode 303 is provided to the end cap electrode 308 at the ion entering side. For reference, an appearance of the ion trap mass analyzer after assembling is indicated in FIG. 15.

Figure 16:
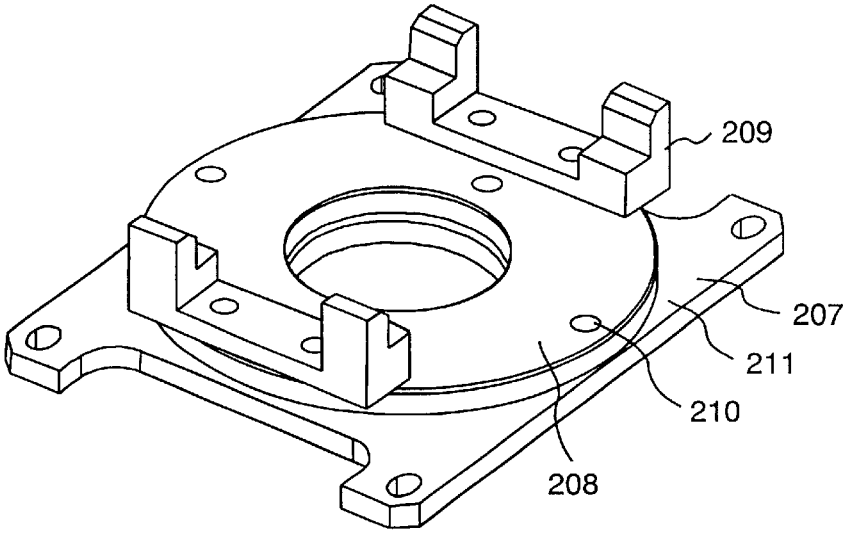
FIG. 16 is a perspective view of a holder for holding the ion trap mass analyzer (mass analysis region)

FIG. 16 is a perspective view of a holder for holding the ion trap mass analyzer. The holder comprises base 207, table 208, and fixing jig 209. Screw portions 210 for fine adjustment of height are provided to the table 208, and height and decline of the table 208 can be controlled by adjusting the four screw portions. A state wherein the ion trap mass analyzer is held by the holder is indicated in FIG. 17.

Figure 19:
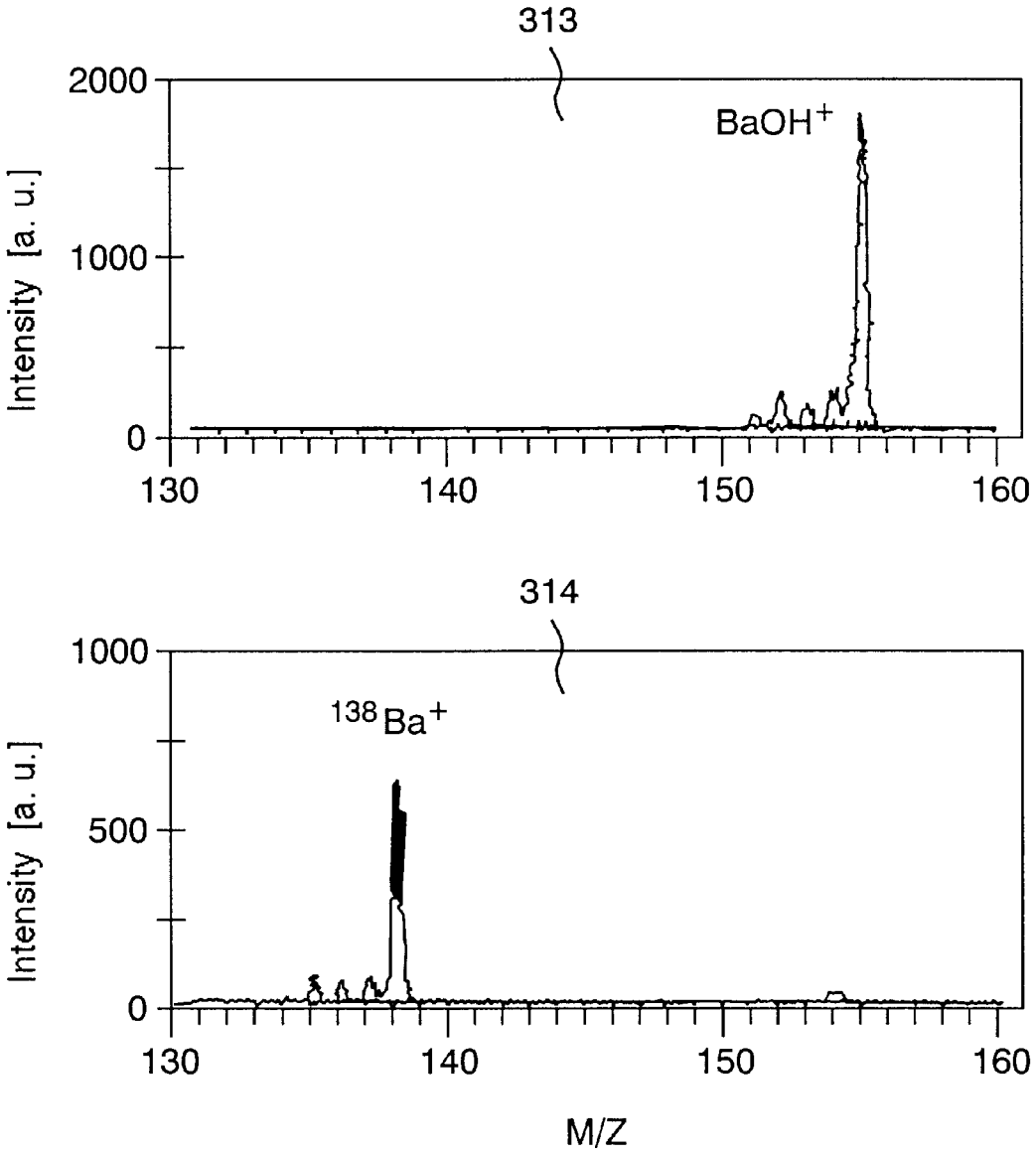
FIG. 19 is a set of graphs for explaining effects caused by applying voltages to respective electrodes of the ion trap mass analyzer (mass analysis region)

A method for operating the plasma ion source ion trap mass analyzer, which is capable of selecting atomic ions, the measuring objects, from the matrix molecule ions such as $ArOH^+$, $NOH^+$, and the like, is explained referring to FIG. 18 and FIG. 19.

FIG. 18 indicates the steps for applying voltages when the analytical method is performed. The method using the ion trap mass analyzer comprises the three steps of isolation 300, collision induced dissociation (hereinafter, called CID) 301, and detection 302.

In the step of the isolation 300, a voltage having a polarity opposite to the measuring object ions is applied to the gate electrode 303. The ions passed through the deflector 304 and the static lens 305 are led by the gate electrode 303, and introduced into the ion trap mass analyzer via the orifices provided to the end cap electrodes 308, 309. Whole ions having a mass number larger than a specified mass number among the ions introduced into the mass analyzer are accumulated inside the mass analyzer depending on the amplitude of a high frequency voltage applied to the ring electrode 306. If another high frequency voltage is applied to the end cap electrodes 308, 309 under this state, only the orbit of the ion having a specified mass number is enlarged depending on its frequency, and the ion is released outside the mass analyzer, or disappeared by collision to the electrode. In order to accumulate only the ions of measuring object at the inner region of the mass analyzer, a high frequency voltage overlapped with multi-wavelength components other than the frequency corresponding to the specified mass number is applied to the end cap electrodes 308, 309. A same voltage as the ions of measuring object is applied to the ion stop electrode 311 for preventing the ions from releasing from the end cap electrode 309 passing the ion trap mass analyzer. A buffer gas is introduced into the inner portion of the mass analyzer from outside to assist collimating the ions by collision with the ions.

In the CID 301, a same voltage as the ions of measuring object is applied to the gate electrode 303. Accordingly, the ions are prevented from entering inner portion of the ion trap mass analyzer from outer portion via the orifice opened at the end cap electrode 308. Furthermore, the ions in the ion trap mass analyzer are prevented from releasing in a direction to the end cap electrode 308. A high frequency voltage, which is capable of accumulating whole ions having a mass number equal to or larger than a specified mass number, is applied to the ring electrode 306. If the difference in mass number of the atomic ion of measuring object from the mass number of molecule ion irrelevant to the atomic ion is small, a problem that the quantitative value of the ion of the measuring object can not be obtained is generated. This problem has been called as spectrum interference.

At this time, a high frequency voltage having a frequency corresponding to the mass number of the ions of measuring object is applied to the end cap electrodes 308, 309, in order to enlarge only the orbits of the ions having the accumulated mass number. Then, the orbits of the ions are enlarged, and the kinetic energy of the ions are increased. Under this state, the ions are collided with buffer gas molecules existing approximately 1 milli-Torr. in the ion trap electrode. Accordingly, internal energies of interfering molecules generated by the collision are increased, decomposition are occurred, and ions having different mass numbers from the numbers before the decomposition are generated. On the other hand, the atomic ions, i.e. the measuring objects, are stayed at the original mass numbers. Therefore, performing a quantitative measurement becomes possible. A same voltage as the gate electrode 303 is applied to the ion trap electrode 311, in order to prevent the ions from releasing from the end cap electrode 309 via the ion trap mass analyzer.

In the step of detection 302, a same voltage as the ions of measuring object is applied to the gate electrode 303. Accordingly, the ions are prevented from entering inside the ion trap mass analyzer from outside via an orifice provided to the end cap electrode 308, and the ions inside the ion trap mass analyzer are prevented from releasing outside in a direction to the end cap electrode 308. In accordance with gradually increasing the amplitude of the high frequency voltage applied to the ring electrode 306, the orbit becomes unstable in the order from the ions having lower mass number, and the ions can be led out in a direction to the end cap. At this time, no voltage is applied to the end cap electrodes 308, 309. However, sometimes a high frequency voltage is applied as an assistance for making the ions unstable. The ions led out in the order from the ions having lower mass number are detected by the detector 312 via the orifice provided to the end cap 309. A voltage opposite to the ions of the measuring object is applied to the ion stop electrode 311, in order to assist the ions being led out in a direction to the end cap electrode 309.

FIG. 19 indicates a set of mass spectrum obtained by performing the present analytical method. When barium is measured with the plasma ion source ion trap mass spectrometer, barium hydroxide which is a hydroxide ion of barium is determined in addition to barium.

First, in accordance with isolation step 300, the orbits of the ions having mass numbers other than the mass number of barium hydroxide ion, which is the measuring object and to be dissociated, are enlarged, and only barium hydroxide ions are accumulated in the mass analyzer. Subsequently, the mass spectrum 313 can be obtained by performing, not the CID 301 step, but the detection step 302. In accordance with the mass spectrum 313, it is revealed that only the barium hydroxide ions are accumulated in the mass analysis region.

Next, after accumulating only barium hydroxide ion by the isolation step 300, the CID step is performed in order to enlarge only the orbit of the ions in the mass number of barium hydroxide ion. The barium hydroxide ion are dissociated to barium ions, which differs from barium hydroxide ions in mass number, by collision with the buffer gas molecules, and the barium ions are accumulated in the mass analysis region. Subsequently, by performing the detection step 302, mass spectrum 314 enabling to detect only barium ions can be obtained. In accordance with the spectrum 314, barium hydroxide ions are not detectable, but only barium ions can be detected. On the other hand, atomic ions having the same mass number with barium hydroxide ion do not make any change in mass number by the collision. Therefore, separation of the molecule ion from the atomic ion is possible.

In accordance with the analytical method described above, it is revealed that the dissociation of matrix molecule ions is possible. In the present embodiment, intake of the ions is restricted by applying a resonance voltage between the end caps during taking the ions in from outside. However, it is also possible to perform the analytical method described above after taking the ions in without any selection.

In accordance with the present invention, photons or droplets, which cause noises in plasma ion source mass spectrometers and liquid chromatograph/mass spectrometers, could be decreased significantly, and a high ion transmission could be maintained. As the result, the S/N ratio could be improved remarkably.

The electrodes, which require frequent cleaning, became to be assembled readily and precisely, and reproducibility of the ion transmission was improved.

The matrix molecule ions became separable from the atomic ions by applying a resonance voltage between the end caps using the ion trap mass analysis region.

Furthermore, in accordance with the present invention, precision of the measurement was improved by suppressing the reactions of the ions with impurities due to vacuum pump.

What is claimed is:

1. A mass spectrometer comprising:

an ion source arranged in a first chamber under a first pressure condition;

an orifice for introducing ions generated in said ion source into a second chamber under a second pressure condition, which is lower than the first pressure condition;

an ion transport region for transporting the ions introduced into the second chamber through the orifice to a desired region; and a mass analyzer for analyzing the ions transported through the ion transport region by mass spectrometry; wherein a gate valve is provided between electrodes composing said ion transport region, a shielding plate having a small opening is provided between said orifice and said gate valve, and a leading electrode for collimating the ions is provided between said orifice and said shielding plate.

2. A mass spectrometer as claimed in claim 1, wherein said leading electrode and said shielding plate are fixed to a flat plate having plural openings, in order to improve preciseness in assembling said leading electrode and said shielding plate.

3. A mass spectrometer as claimed in claim 1, wherein a differential pumping region under a third pressure condition, which is intermediate between the first pressure condition and the second pressure condition, is provided between said first chamber and said second chamber.

4. A mass spectrometer as claimed in claim 1, wherein said ion source is any one of plasma ion source, electrospray ion source, atmospheric chemical ionization ion source, and sonicspray ion source.

5. A mass spectrometer as claimed in claim 1, wherein said mass analysis region is ion trap type.

6. A mass spectrometer as claimed in claim 1, wherein said ion transport region is composed of ion collimating lenses and a deflector.

7. A mass spectrometer as claimed in claim 1, wherein any one of said ion collimating lenses is a double cylindrical type static lens.

8. A mass spectrometer as claimed in claim 6, wherein said deflector deflects orbit of said ions by 90 degrees.

9. A mass spectrometer as claimed in claim 6, wherein said deflector is composed of plural sector-shaped electrodes.

10. A mass spectrometer as claimed in claim 6, wherein said deflector is a quadrupole deflector having a shape of quartered cylinders.

11. A mass spectrometer as claimed in claim 5, further comprising:

a power source applying a high frequency wave having a designated frequency between a pair of end cap electrodes, which composes said ion trap mass analyzer.

12. A mass spectrometer as claimed in claim 11, wherein the distance between said pair of end cap electrodes is at least 20 mm.

13. A mass spectrometer as claimed in claim 11, wherein said end cap electrode has an opening, and diameter of said opening is at least 2 mm.

14. A mass spectrometer as claimed in claim 3, further comprising:

an oil-free scroll pump for pumping said differential pumping region.

15. A mass spectrometer comprising:

a plasma ion source, a first lens for collimating the ions from said plasma ion source, a gate valve to maintain vacuum in a chamber of the mass spectrometer, a second lens for collimating the ions from said gate valve, a deflector for deflecting a direction of the ions passed through said second lens, a third lens for collimating the ions from said deflector, and an ion trap mass analyzer, further comprising:

a shielding plate having an opening arranged between said gate valve and said first lens.

* * * * *